US005543808A

United States Patent [19]

Feigenbaum et al.

[11] Patent Number: 5,543,808

[45] Date of Patent: Aug. 6, 1996

[54] DUAL BAND EHF, VHF VEHICULAR WHIP ANTENNA

[75] Inventors: Bernard E. Feigenbaum, Neptune; Francis G. Loso, Keyport, both of N.J.

[73] Assignee: The United States of America as represented by the Secretary of the Army, Washington, D.C.

[21] Appl. No.: 449,192

[22] Filed: May 24, 1995

[51] Int. Cl.[6] ..... H01Q 21/00; H01Q 1/32

[52] U.S. Cl. ..... 343/727; 343/725; 343/730; 343/792

[58] Field of Search ..... 343/727, 725, 343/729, 730, 790, 791, 792, 853, 715; H01Q 21/00, 1/32, 21/29, 21/30

[56] References Cited

U.S. PATENT DOCUMENTS 3,541,556 11/1970 Cheillan ..... 343/727

3,739,390 6/1973 Poppe, Jr. et al. ..... 343/729

*Primary Examiner*—Hoanganh Le

*Attorney, Agent, or Firm*—Michael Zelenka; William H. Anderson

[57] ABSTRACT

A dual-band antenna in which EHF signals are connected to one end of a waveguide and radiated from the other and wherein a half-dipole for VHF signals is connected to the radiating end of the waveguide and the other half-dipole for VHF is formed by a shield that is coaxial with and surrounds all of the waveguide except the radiating end. VHF signals are coupled to the half-dipole formed by the shield via a matching network.

4 Claims, 1 Drawing Sheet

DUAL BAND EHF, VHF VEHICULAR WHIP ANTENNA

GOVERNMENT INTEREST

The invention described herein may be manufactured, used, and licensed by or for the Government of the United States of America without payment to us of any royalty thereon.

FIELD OF INVENTION

This invention relates in general to antennas.

BACKGROUND OF THE INVENTION

In previous dual-band antennas designed for use on a vehicle the radiating element for the EHF band (Extra-High Frequency which is around 54 GHz) has been so close to the vehicle that its radiation pattern is undesirable due to blockage from and interaction with vehicle obstructions. Furthermore, the previous designs have been such that it is obvious to an observer that the antenna has dual-band capability, and in a military application this can be highly disadvantageous.

SUMMARY OF THE INVENTION

In accordance with this invention, EHF frequencies are coupled to one end of a waveguide, and a radiating means is coupled to the other. A shield that surrounds all but the radiating end of the waveguide effectively forms with it a coax for the VHF band (very High Frequency which is between 30–88 MHz) of frequencies and the radiating end of the waveguide is connected to the VHF upper half-dipole so as to couple the VHF frequencies to it. The shield serves as the lower half-dipole for VHF.

The EHF radiating means is elevated above the carrying vehicle by the length of the half-dipole shield, thereby preventing the vehicle from interfering with the EHF radiating pattern. Furthermore, the EHF radiating element is fabricated within the physical profile of the VHF whip antenna so as to be inconspicuous as is desired in some military operations.

BRIEF DESCRIPTION OF THE DRAWINGS

These and other features of the present invention will be readily understood in light of the following Detailed Description of the Invention and the attached drawings wherein.

DETAILED DESCRIPTION OF THE INVENTION

In this description the lower band of signals will be referred to as VHF and the upper band of signals will be referred to as EHF, but different bands of signals could be used.

Figure 1:
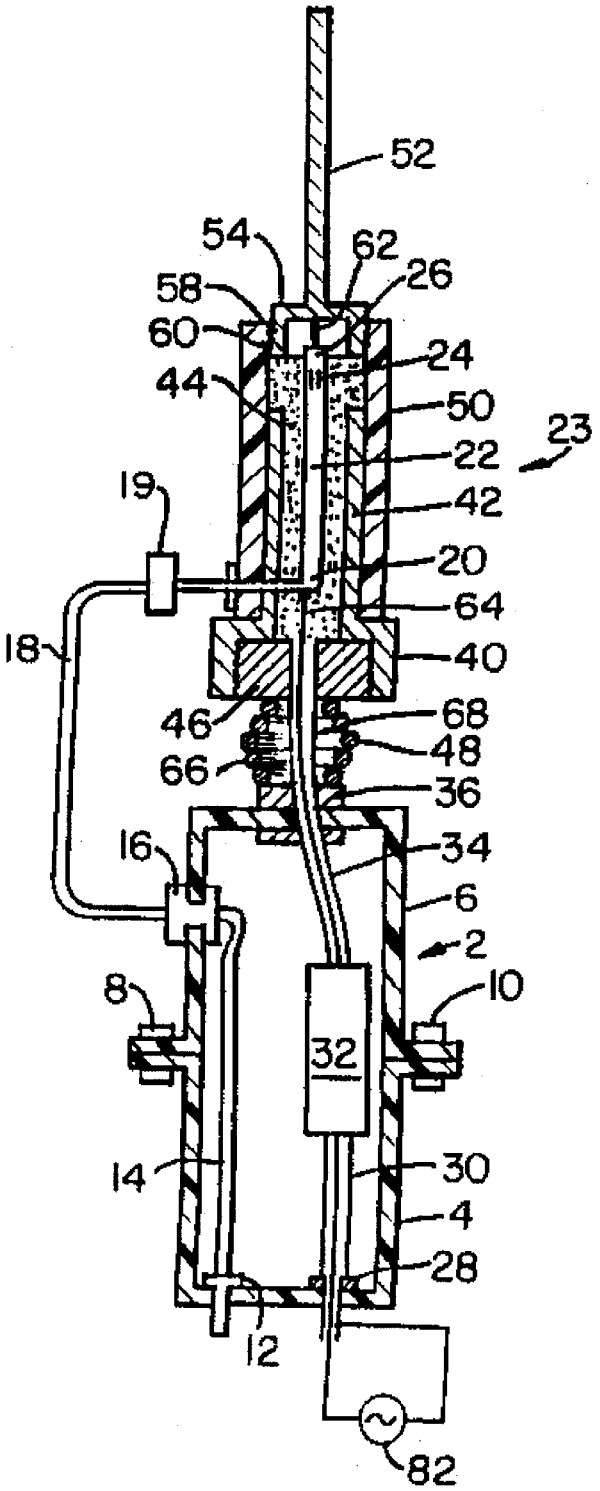
FIG. 1 is a vertical cross sectional view of a dual-band antenna embodying this invention.

In FIG. 1 a plastic nonconductive mounting base 2 is comprised of a lower half 4 and an upper half 6 that is joined to it via bolts 8 and 10 that may also be used to attach the base 2 to a vehicle.

EHF signals are applied to a coax 12 that is waveguide flange mounted in the bottom of the lower half 4 of the base 2. The EHF signals are conducted via a waveguide 14 to a connector 16 mounted in the upper half 6 of the base 2, and via a flexible waveguide 18 and a waveguide flange 19 to the bottom 20 of an EHF rigid waveguide 22 that is part of an antenna assembly 23 to be described. Radiating means such as slots 24 (slot antenna) are formed in the top 26 of the EHF waveguide 22.

VHF signals are applied to a coax connector 28 that is mounted in the bottom of the lower half 4 of the base 2, and are conducted via a coax 30 to the input of a matching network 32 for reasons to be explained. The output of the matching network 32 is coupled via a coax 34 to a coax connector 36 mounted in the top of the upper half 6 of the base 2. As shown, the coupler 36 is connected to the shield of the coax 34.

The antenna assembly 23 is comprised of a conductive annular support 40 having a coaxial hollow cylinder 42 extending upwardly therefrom. The support 40 and the cylinder 42 are concentric with the EHF waveguide 22, and the space 44 between the waveguide 22 and the cylinder 42 is filled with a dielectric material. The inner surface of the annular support 40 is provided with threads that mate with threads on the outside of an annular socket 46 made of conductive material.

A metal coiled spring 48 is attached to the upper side of the metal connector 36 and to the lower side of the annular socket 46 so that the cylinder 42, the annular support 40, the socket 46 and the connector 36 are electrically connected. The spring 48 allows the antenna assembly 23 to move When it bears against an object.

The rest of the antenna assembly 23 is further comprised of a plastic sleeve 50 that is concentric with the cylinder 42 and in contact therewith. The bottom of the sleeve 50 rests on the annular support 40, and its top extends above the top 26 of the EHF waveguide 22. A half-dipole antenna 52 is secured to a hollow cylindrical member 54 that has external threads 58 that mate with internal threads 60 at the top of the plastic sleeve 50. A conductor 62 is connected between the member 54 and the top 26 of the EHF waveguide 22.

The other end 20 of the EHF waveguide 22 is connected by a lead 64 to the central conductor 66 of a coax 68 that is coupled between the annular socket 46 and the coax connector 36.

The path followed by the EHF signals is from the connector 12 at the bottom of the base 2 and via the coax 14, the connector 16, the coax 18 and the waveguide transition means 19 to the bottom 20 of the EHF waveguide 22. The signals pass through the waveguide 22 to its top end 26 where they radiate through the slots 24.

The path followed by the VHF signals is from the connector 28 and via the coax 30, the matching network 32, the coax 34, the connector 36, the coax 68 and the coax formed by the waveguide 22 and the shield 42 and the conductor 62 to the half-dipole 52. As will be apparent from a discussion of FIGS. 2 and 3, the lower half-dipole includes the cylinder 42, the annular support 40, the annular socket 46, the spring 48 and the connector 36. A RF choke, not shown, within matching network 32 isolates the coax 34 from interacting with the lower half-dipole.

Figure 2:
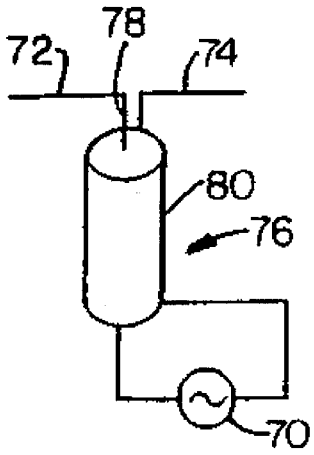
FIG. 2 PRIOR ART
FIG. 2 shows the usual coupling of a coax to a horizontal dipole antenna.

FIG. 2 illustrates the usual coupling of a signal source 70 to half-dipoles 72 and 74 via a quarter wavelength coax 76 comprised of a central conductor 78 and a shield 80. With this configuration, the quarter wavelength coax acts as a RF choke which prevents currents on the shield 80. The central conductor 78 is connected to the half-dipole 72, and the shield 80 is connected to the half-dipole 74 so that the adjacent ends of the dipoles are excited by the quarter wavelength coax 76.

Figure 3:
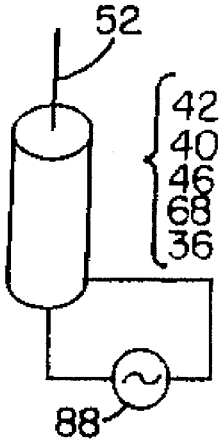
FIG. 3 PRIOR ART
FIG. 3 shows the usual coupling of a coax to a vertical dipole antenna.

FIG. 3 illustrates the connections of a signal source 82 of FIG. 1 to the half-dipole 52 and the lower half-dipole comprised of the connector 36, the coax 68, the connector 46, the annular support 40 and the cylinder 42 that are effectively the shield of a quarter wavelength coax having the waveguide 22 as a central conductor.

Summarizing, the antenna assembly 23 is mounted on the plastic base 2 by the spring 48, and the waveguide 18 is flexible so as to permit the assembly to be moved with respect to the base 2 without causing any damage. The rigid plastic cylinder 50 provides further protection. The waveguide 22 forms the central conductor of a coax for VHF, and the means for providing a shield therefore includes the metal cylinder 42, the metal support 40, the connector 46, the spring 48, and the connector 36. VHF signals are supplied via the matching network 32 to one end of the coax thus formed. The upper half-dipole 52 is connected to the upper end 26 of the waveguide 22, and the means for providing a shield just described acts as the lower half-dipole.

As previously explained, the matching network 32 causes the phase of the VHF signals to be proper. EHF signals are coupled to the lower end 20 of the waveguide 22 and are radiated out the slots 24, at its other end 26 that is located between the upper and lower half-dipoles.

The means for coupling the VHF signals to the input of the matching network includes the connector 28 and the coax 30, and the means for coupling the output of the matching network to the means for providing a shield includes the coax 34.

By means known to those skilled in the art, a biconical horn could be mounted instead of the slots 24 so as to attain a desired radiating pattern.

Having thus shown and described what is at present considered to be the preferred embodiment of the invention, it should be noted that the same has been made by way of illustration and not limitation. For example, the coax elements 14 and 18 may be coax or other means of EHF waveguides. Accordingly, all modifications, alterations and changes coming within the spirit and scope of the invention are herein meant to be included.

What is claimed is:

1. A dual-band whip antenna comprising:

a EHF waveguide;

means for coupling EHF signals to one end of said EHF waveguide;

means for radiating EHF signals from the other end of said EHF waveguide, wherein said means for radiating EHF signals includes at least one slot;

a half dipole conductively connected to said other end of said EHF waveguide;

means for providing a shield around all of said waveguide except the means for radiating EHF signals;

a VHF matching network having an input and an output;

means for coupling VHF to said input; and means for coupling said output to said one end of said waveguide and to said means for providing a shield at a point remote from said other end of said waveguide;

whereby said means for providing a shield acts as a half dipole.

2. A dual-band antenna as set forth in claim 1, wherein said means for providing a shield includes a coiled spring.

3. A dual-band antenna comprising:

an annular metal support;

a metal cylinder coaxial with and extending from one side said support;

a EHF waveguide mounted coaxially within said metal cylinder, one end of said waveguide extending beyond said cylinder;

means for radiating EHF signals coupled to said one end of said waveguide;

a half-dipole;

means for mounting said half-dipole coaxially with said waveguide so that said means for radiating EHF is between an end of said half-dipole and said cylinder, thereby providing a window through which radiation may pass;

a VHF matching network having a coaxial input adapted for receiving VHF signals and a coaxial output having a central conductor and a sheath;

a coiled spring having two ends;

means for physically and electrically connecting one end of said coiled spring to the sheath of said output;

means for physically and electrically connecting the other end of said spring to said support;

means for connecting the central conductor of said output to the other end of said waveguide, whereby said cylinder and said spring act as a half-dipole; and means for coupling EHF signals to the other end of said waveguide.

4. A dual-band antenna comprising:

a waveguide for conveying EHF signals having first and second ends;

a first shield that is coaxial with said waveguide and which surrounds all but said first end of said waveguide;

means coupled to said first end of said waveguide for radiating EHF signals, wherein said means for radiating EHF signals includes at least one slot;

means for coupling EHF signals to said second end of said waveguide;

a coax for conveying VHF signals having one end of a central conductor connected to the second end of said waveguide and one end of a second shield connected to the end of said first shield that is adjacent said second end of said waveguide;

a first half-dipole connected to said first end of said waveguide; and a VHF matching network coupled to the other ends of said central conductor and said second shield of said coax;

whereby VHF signals are conveyed to said first half-dipole via the coax formed by said waveguide and said first shield and said second shield acts as a second half-dipole.

* * * * *